US006276344B1

(12) United States Patent
Isobe et al.

(10) Patent No.: US 6,276,344 B1
(45) Date of Patent: Aug. 21, 2001

(54) EVAPORATED FUEL LEAK DETECTION APPARATUS

(75) Inventors: Takashi Isobe; Takashi Yamaguchi, both of Saitama; Satoshi Kiso, Haga-gun, all of (JP)

(73) Assignee: Honda Giken Kogyo Kabushikikaisha, Tokyo (JP)

( * ) Notice: Subject to any disclaimer, the term of this patent is extended or adjusted under 35 U.S.C. 154(b) by 0 days.

(21) Appl. No.: 09/506,865

(22) Filed: Feb. 4, 2000

(30) Foreign Application Priority Data

Feb. 5, 1999 (JP) ..... 11-029263
Nov. 2, 1999 (JP) ..... 11-312238

(51) Int. Cl.[7] ..... F02M 33/04
(52) U.S. Cl. ..... 123/520; 123/519
(58) Field of Search ..... 123/516, 518, 123/519, 520, 198 D

(56) References Cited

U.S. PATENT DOCUMENTS 5,765,539 * 6/1998 Isobe et al. ..... 123/520
5,775,307 * 7/1998 Isobe et al. ..... 123/520
5,799,639 * 9/1998 Isobe et al. ..... 123/520
5,826,566 * 10/1998 Isobe et al. ..... 123/520
5,845,625 * 12/1998 Kidokoro et al. ..... 123/520
5,954,034 * 9/1999 Takagi ..... 123/520

FOREIGN PATENT DOCUMENTS 07 012016 1/1995 (JP) .

* cited by examiner

*Primary Examiner*—Thomas N. Moulis
(74) *Attorney, Agent, or Firm*—E. Russell Tarleton; Seed IP Law Group PLLC

(57) ABSTRACT

An evaporated fuel leak detection apparatus for an internal combustion engine that has a fuel tank, a canister with an opening to the atmosphere, a charging passage that causes the fuel tank to communicate with the canister, a pressure adjustment valve installed in the charging passage, an internal pressure sensor installed on the upstream side of the pressure adjustment valve to detect the internal pressure of the fuel tank, and a controller that detects leakage in the fuel tank system on the upstream side of the pressure adjustment valve in accordance with the output of the internal pressure sensor. The controller judges that there is no leakage in cases where the internal pressure sensor indicates a negative pressure, and the vehicle is not in a high-load operating state or when variation in atmospheric pressure is less than a predetermined amount.

14 Claims, 6 Drawing Sheets

EVAPORATED FUEL LEAK DETECTION APPARATUS

FIELD OF THE INVENTION

The present invention concerns an evaporated fuel treatment apparatus for an internal combustion engine fuel tank system, which releases the evaporated fuel generated inside the fuel tank into the air intake system of the internal combustion engine. More concretely, the present invention concerns an evaporated fuel leak detection apparatus for an internal combustion engine fuel tank system that makes it possible to ascertain the presence or absence of leakage in an evaporated fuel discharge prevention system extending from the fuel tank to the engine air intake system.

BACKGROUND OF THE INVENTION

A method for judging the presence or absence of leakage in the discharge prevention system of an evaporated fuel treatment apparatus is described in Japanese Patent Application Kokai No. Hei 7-12016. In this method, in cases where the detected tank pressure is a negative pressure that differs from atmospheric pressure by a predetermined value or greater, this indicates that purging is being performed in a normal evaporated fuel treatment system (in the case of ordinary engine operation). Accordingly, it is judged in such cases that the evaporated fuel treatment system is in a normal state, with no leakage of evaporated fuel from said system. In cases where the system is not judged to be normal in this judgment process, e.g., in cases where the internal pressure of the fuel tank remains stationary in the vicinity of atmospheric pressure for a predetermined period of time, it is considered that there is a possibility of leakage, and a negative pressure diagnostic process is actuated. In this process, the discharge prevention system is placed in a state of negative pressure, and the presence or absence of leakage is ultimately detected from the ability of the system to maintain this negative pressure.

Furthermore, an evaporated fuel treatment apparatus which is equipped with a bypass that bypasses the pressure adjustment valve in a charging passage that causes the fuel tank to communicate with the abovementioned canister, and which separately judges the presence or absence of leakage in the tank system on the fuel tank side of the bypass valve and the presence or absence of leakage in the canister system on the canister side of the bypass valve, is described in Japanese Patent Application Kokai No. Hei 9-317572. Judgment of the presence or absence of leakage in the tank system is accomplished as follows: Immediately after the engine is started, the bypass valve is opened so that the system is caused to move toward atmospheric pressure. If the shift in the pressure of the fuel tank in this case is greater than a predetermined value, it is judged that the tank system is in a normal state with no leakage. If there is leakage in the tank system, the pressure of the fuel tank prior to the starting of the engine will be more or less equal to atmospheric pressure, so that the shift in pressure is small.

As consideration for the environment has become more important, there has been a demand for stricter criteria for judging the presence or absence of leakage. However, the internal pressure in a fuel tank constantly varies due to various factors such as the temperature of the fuel, the extent to which excess fuel from the engine space is returned, the load conditions of the vehicle, and vibration, etc. As a result, difficulties have been experienced in the accurate detection of leakage caused by very small holes.

In cases where leakage is detected in spite of the fact that there is actually no leakage, the frequent lighting of a warning lamp, or other indicator lowers the practical utility of the vehicle. Conversely, if no leakage is detected in spite of the fact that leakage is actually occurring, evaporated fuel continues to be emitted into the atmosphere. Accordingly, an object of the present invention is to provide an evaporated fuel treatment apparatus that enables the correct detection of leakage caused by very small holes (e.g., holes with a diameter of 0.5 mm).

SUMMARY OF THE INVENTION

In order to solve the abovementioned problems, according to one aspect of the invention, an evaporated fuel leak detection apparatus for an internal combustion engine is provided, which has a fuel tank, a canister which has an opening to the atmosphere, a charging passage which allows the fuel tank to communicate with the canister, a pressure adjustment valve which is installed in the charging passage, an internal pressure sensor which is installed on the upstream side of the pressure adjustment valve for detecting the internal pressure of the fuel tank, and a controller which detects leakage in the fuel tank system on the upstream side of the pressure adjustment valve in accordance with the output of the sensor, the controller determining that there is no leakage when the internal pressure sensor indicates a negative pressure and the engine is not in high-load operating conditions.

It has been discovered that even in cases where a very small hole is opened in an evaporated fuel treatment apparatus, the tank pressure temporarily shows a negative pressure if the vehicle is operating under a high load, e.g., during rapid acceleration, etc. According to one aspect of the invention, a judgment is made that there is no leakage when the internal pressure sensor shows a negative pressure and the vehicle is not in a high-load operating state. Accordingly, the erroneous interpretation of a negative-load state in the tank system arising from a high-load state as a state in which there is no leakage in the tank system can be prevented.

According to another aspect of the invention, an evaporated fuel treatment apparatus is provided for an internal combustion engine that has a fuel tank, a canister that has an opening to the atmosphere, a charging passage that allows the fuel tank to communicate with the canister, a pressure adjustment valve that is installed in the charging passage, an internal pressure sensor that is installed on the upstream side of the pressure adjustment valve for detecting the internal pressure of the fuel tank, and a controller that detects leakage in the fuel tank system on the upstream side of the pressure adjustment valve in accordance with the output of the sensor, the controller judging that there is no leakage when the internal pressure sensor indicates a negative pressure and the variation of atmospheric pressure is less than a predetermined value.

It has been discovered that even in cases where a very small hole is opened in an evaporated fuel treatment apparatus, the tank pressure detected by the internal pressure sensor varies toward a negative pressure if the atmospheric pressure varies in the direction of increase, e.g., when the vehicle moves from a higher altitude toward a lower altitude. According to another aspect of the invention, a judgment is made that there is no leakage when the internal pressure sensor shows a negative pressure and there is no variation exceeding a predetermined value in the atmospheric pressure. Accordingly, the erroneous interpretation of a negative-load state in the tank pressure arising from a change in atmospheric pressure as a state in which there is no leakage in the tank system can be prevented.

DETAILED DESCRIPTION OF THE INVENTION

Figure 1:
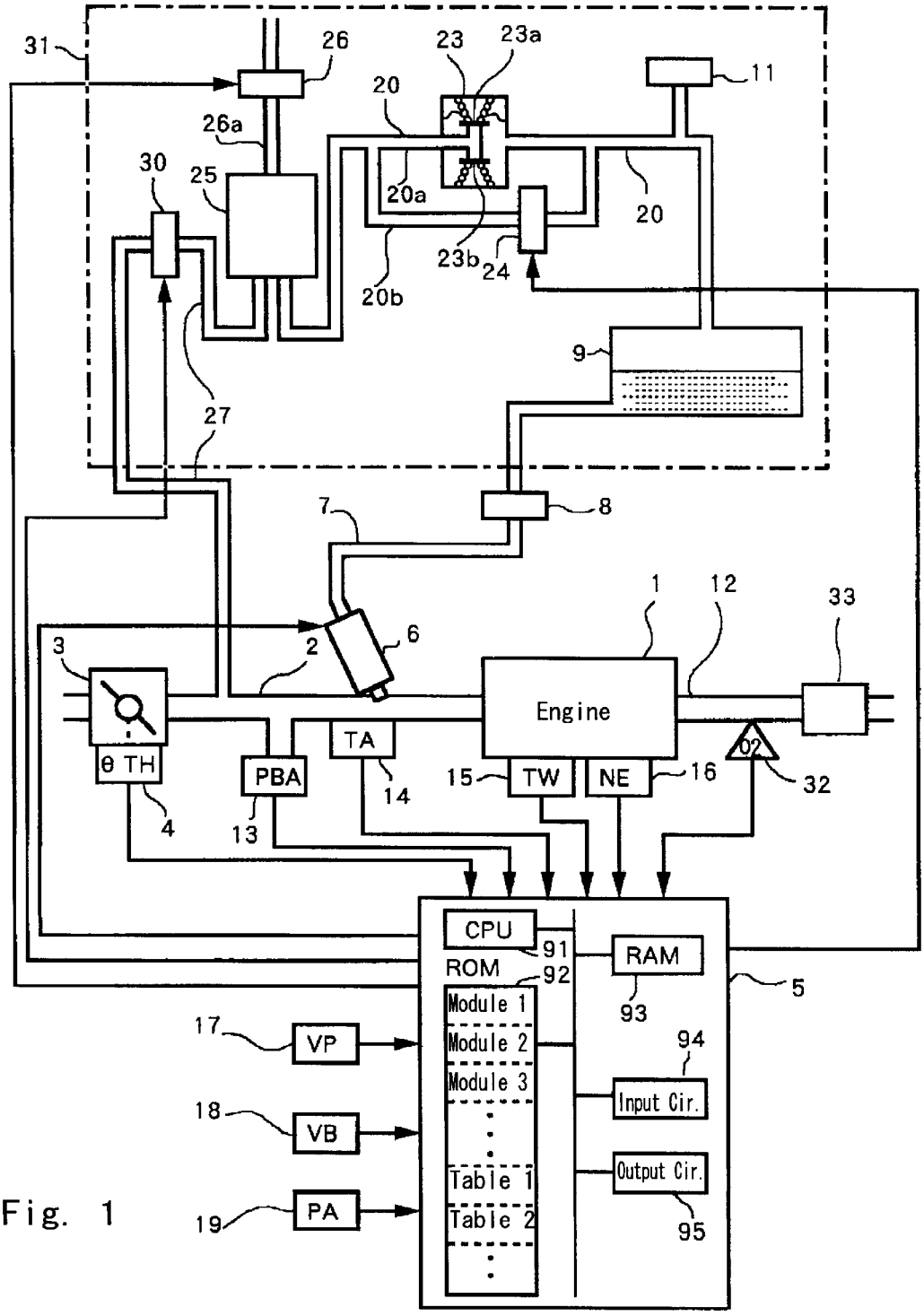
FIG. 1 is a diagram illustrating the overall construction of the evaporated fuel treatment apparatus of the present invention.

An embodiment of the present invention will be described with reference to the attached figures. FIG. 1 is an overall structural diagram of an evaporated fuel treatment apparatus for an internal combustion engine constructed according to a working configuration of the present invention. This apparatus is equipped with an internal combustion engine (hereafter referred to as the "engine") 1, an evaporated fuel discharge prevention device 31 and an electronic control unit (hereafter referred to as the "ECU") 5.

The ECU 5, which in the present invention constitutes a controller, is equipped with a CPU 91, which performs operations in order to control various parts of the engine, a read-only memory (ROM) 92, which stores various types of data and programs that are used to control various parts of the engine, a random-access memory (RAM) 93, which provides a working region for operations by the CPU 91, and which temporarily stores data sent from various parts of the engine and control signals that are to be sent out to various parts of the engine, an input circuit 94, which receives data sent from various parts of the engine, and an output circuit 95, which sends out control signals to various parts of the engine.

In FIG. 1, the programs are indicated as module 1, module 2, module 3, etc. For example, the program that detects the presence or absence of leakage in the present invention is contained in modules 3, 4, 5, and 6. Furthermore, the various types of data used in the abovementioned operations are stored in the ROM 92 in the form of table 1, table 2, etc. The ROM 92 may be a re-writable ROM such as an EEPROM. In such a case, the results obtained from the operations of the ECU 5 in a given operating cycle are stored in the in the ROM, and can be utilized in the next operating cycle. Furthermore, considerable quantities of flag information set in various processes can be recorded in the EEPROM and utilized in trouble diagnosis.

For example, the internal combustion engine 1 may be an engine equipped with four cylinders, and with an intake manifold 2 connected to this engine. A throttle valve 3 is installed on the upstream side of the intake manifold 2, and a throttle valve opening sensor (TH) 4, which is linked to the throttle valve 3, output an electrical signal that corresponds to the degree of opening of the throttle valve 3, and sends this electrical signal to the ECU.

A fuel injection valve 6 is installed for each cylinder at an intermediate point in the intake manifold 2 between the engine 1 and the throttle valve 3. The valve opening time is controlled by control signals from the ECU. A fuel supply line 7 connects the fuel injection valves 6 and the fuel tank 9, and a fuel pump 8 installed at an intermediate point in this fuel supply line 7 supplies fuel from the fuel tank 9 to the fuel injection valves 6. A regulator (not shown in the figures) is installed between the pump 8 and the respective fuel injection valves 6. Thc regulator acts to maintain the differential pressure between the pressure of the air taken in from the intake manifold 2 and the pressure of the fuel supplied via the fuel supply line 7 at a constant value. In cases where the pressure of the fuel is too high, the excess fuel is returned to the fuel tank 9 via a return line (not shown in the figures). Thus, the air taken in via the throttle valve 3 passes through the intake manifold 2. The air is then mixed with the fuel injected from the fuel injection valves 6, and it is supplied to the cylinders of the engine 1.

An intake manifold pressure (PBA) sensor 13 and an intake air temperature (TA) sensor 14 are mounted in the intake manifold 2 on the downstream side of the throttle valve 3. These sensors convert the intake manifold pressure and intake air temperature into electrical signals, and send these signals to the ECU 5.

An engine water temperature (TW) sensor 15 is attached to the cylinder peripheral wall (filled with cooling water) of the cylinder block of the engine 1. The sensor 15 detects the temperature of the engine cooling water, converts this temperature into an electrical signal, and sends the result to the ECU 5. An engine rpm (NE) sensor 16 is attached to the periphery of the cam shaft or the periphery of the crank shaft of the engine 1. The sensor outputs a signal pulse (TDC signal pulse) at a predetermined crank angle position with every 180-degree rotation of the crank shaft of the engine 1, and sends this signal to the ECU 5.

The engine 1 has an exhaust manifold 12, and exhaust gases are discharged via a ternary catalyst 33 constituting an exhaust gas cleansing device, which is installed at an intermediate point in the exhaust manifold 12. An 02 sensor 32 constitutes an exhaust gas concentration sensor. The sensor 32 is mounted at an intermediate point in the exhaust manifold 12. The sensor 32 detects the oxygen concentration in the exhaust gas, and sends a signal corresponding to the detected value to the ECU 5.

A vehicle speed sensor 17, a battery voltage sensor 18, and an atmospheric pressure (PA) sensor 19 are connected to the ECU. These sensors respectively detect the running speed of the vehicle, the battery voltage, and the atmospheric pressure, and send these values to the ECU 5.

The input signals from the various types of sensors are sent to the input circuit 94. The input circuit 94 shapes the input signal waveforms, corrects the voltage levels to predetermined levels, and converts analog signal values into digital signal values. The CPU 91 processes the resulting digital signals, performs operations in accordance with the programs stored in the ROM 92, and creates control signals that are sent out to actuators in various parts of the vehicle. These control signals are sent to the output circuit 95, and the output circuit 95 sends the control signals to actuators such as the fuel injection valves 6, bypass valve 24, vent shut valve 2, and purge control valve 30, etc.

Next, the evaporated fuel discharge prevention system 31 will be described. The discharge prevention system 31 is equipped with a fuel tank 9, a charging passage 20, a canister 25, a purging passage 27 and several control valves. The system 31 controls the discharge of evaporated fuel from the fuel tank 9. The discharge prevention system 32 can be conveniently viewed as being divided into two parts, with the bypass valve 24 in the charging passage 20 as the boundary between the two parts. The side including the fuel tank 9 is referred to as the tank system, while the side including the canister 25 is referred to as the canister system.

The fuel tank 9 is connected to the canister 25 via the charging passage 20, and the system is thus arranged so that evaporated fuel from the fuel tank 9 can move to the canister 25. The charging passage 20 has a first branch 20*a* and a second branch 20*b*, which are installed inside the engine space. An internal pressure sensor 11 is attached to the fuel tank side of the charging passage 20. The sensor 11 detects the differential pressure between the internal pressure of the charging passage 20 and atmospheric pressure. In a normal state, the pressure inside the charging passage 20 is more or less equal to the pressure inside the fuel tank 9. Accordingly, the internal pressure detected by the internal pressure sensor 11 may be viewed as the pressure in the fuel tank 9 (hereafter referred to as the "tank pressure").

A two-way valve 23, which controls pressure in the fuel tank, is installed in the first branch 20*a*. The two-way valve 23 is equipped with two mechanical valves 23*a* and 23*b*. The valve 23*a* is a positive-pressure valve which opens when the tank pressure reaches a value that is approximately 15 mmHg higher than atmospheric pressure. When this valve is in an open state, evaporated fuel flows to the canister 25, and is adsorbed in the canister. The valve 23*b* is a negative-pressure valve which opens when the tank pressure is approximately 10 mmHg to 15 mmHg lower than the pressure on the side of the canister 25. When this valve is in an open state, the evaporated fuel adsorbed in the canister 25 returns to the fuel tank 9.

A bypass valve 24, which is an electromagnetic valve, is installed in the second branch 20*b*. This bypass valve 24 is ordinarily in a closed state. When leakage is detected in the discharge prevention system 31 of the present invention, the opening and closing action of this valve is controlled by control signals from the ECU 5.

The canister 25 contains active carbon that adsorbs the evaporated fuel, and has an air intake port (not shown in the figures) that communicates with the atmosphere via a passage 26*a*. A vent shut valve 26, which is an electromagnetic valve, is installed at an intermediate point in the passage 26*a*. This vent shut valve 26 is ordinarily in an open state, and when leakage is detected in the discharge prevention system 31 of the present invention, the opening and closing action of this valve is controlled by control signals from the ECU 5.

The canister 25 is connected to the intake manifold 2 on the downstream side of the throttle valve 3 via a purging passage 27. A purge control valve 30, which is an electromagnetic valve, is installed at an intermediate point in the purging passage 27. The fuel adsorbed in the canister 25 is appropriately purged into the intake system of the engine via this purge control valve 30. The on-off duty ratio of the purge control valve 30 is altered on the basis of control signals from the ECU 5, so that the flow rate is continuously controlled.

Next, an outline of the process used to judge the presence or absence of leakage in the discharge prevention system 31 will be described. The process used to judge the presence or absence of leakage in the tank system includes an opening treatment performed after starting, and monitoring of the tank pressure.

Opening Treatment Following Starting

In the opening treatment performed after starting, the bypass valve 24 is opened so that the pressure of the discharge prevention system 31 is opened to atmospheric pressure. In this case, if the tank pressure shifts from the value measured prior to the opening of the system to the atmosphere by an amount equal to or greater than a predetermined value, it is judged that the tank system is normal, with no leakage.

Figure 2:
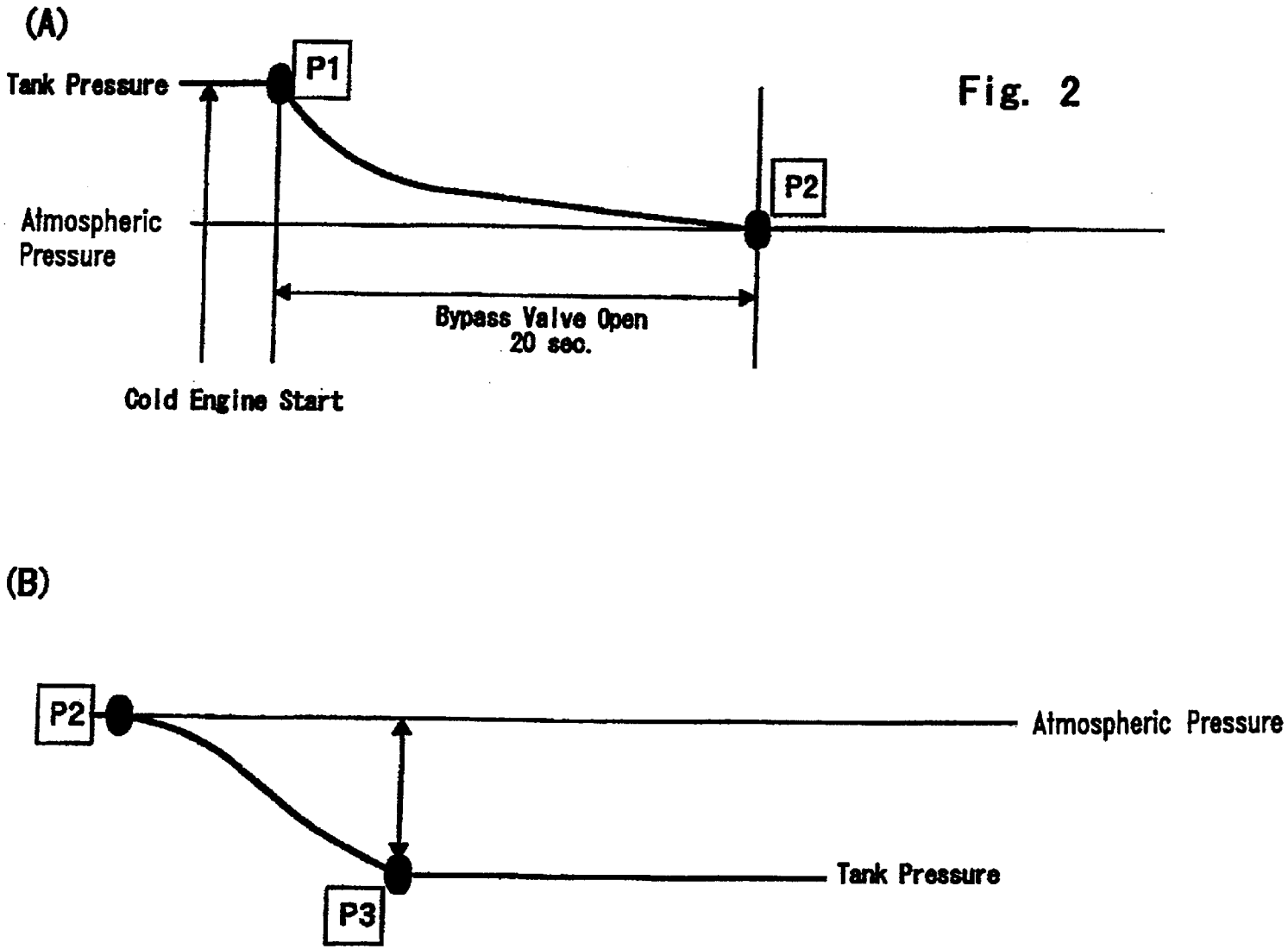
FIG. 2A is a graph that shows changes in the tank pressure that occur when the tank system is opened to the atmosphere immediately following the starting of the engine.
FIG. 2B is a graph that shows the shift of the tank pressure under ordinary conditions.
Figure 3:
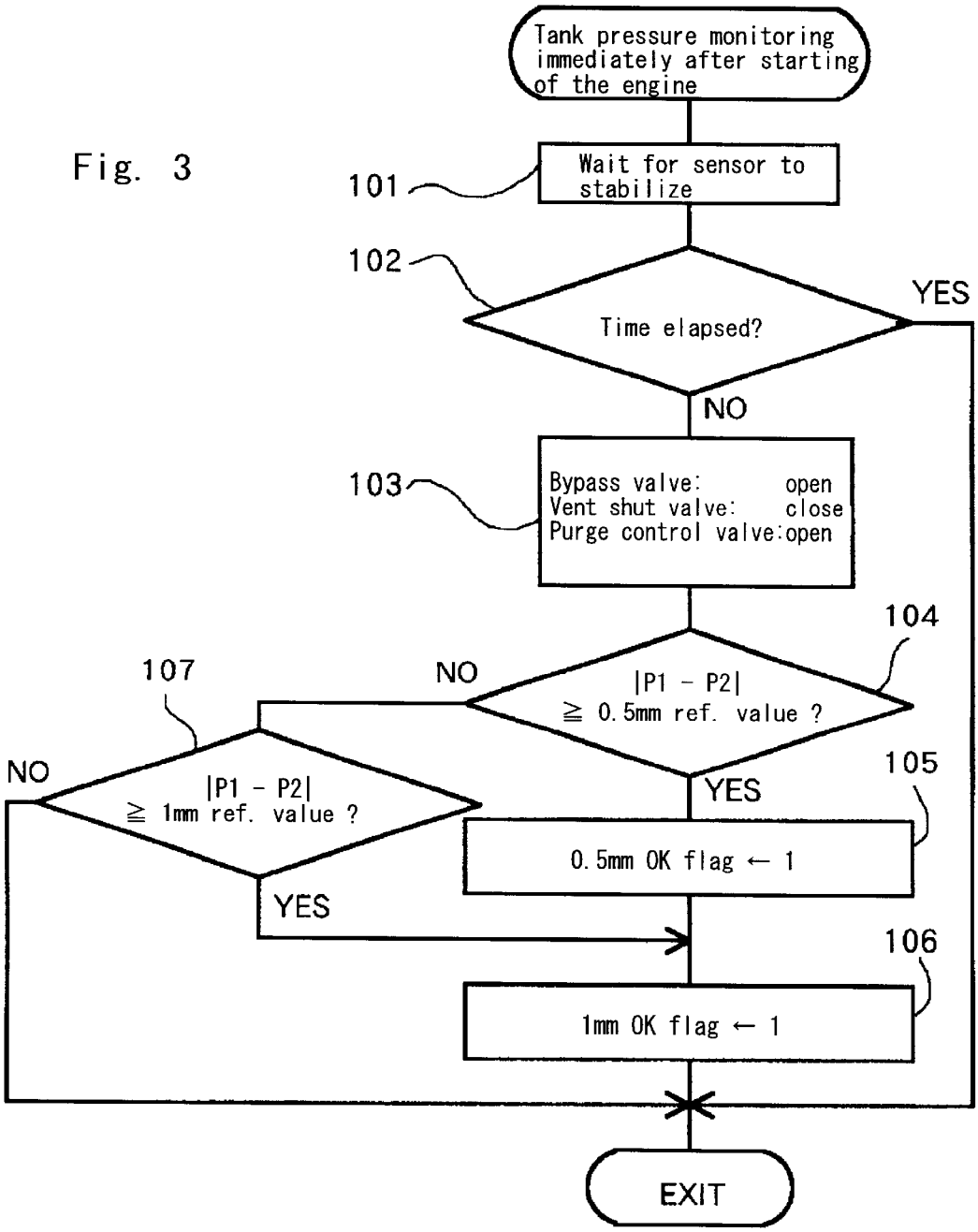
FIG. 3 is a flow chart that illustrates the flow of tank pressure monitoring immediately after starting.

The opening treatment following starting will be described with reference to the timing chart of FIG. 2 and the flow chart shown in FIG. 3. When the engine is started, the ECU 5 first detects the output of the internal pressure sensor 11 and then stores this output in a RAM 93 (with which the ECU 5 is equipped) as the initial value P1 of the tank pressure. When the predetermined time required for the output of the internal pressure sensor 11 to stabilize has elapsed (101), a judgment is made by means of a timer in step 102 as to whether or not the opening treatment time has elapsed. If the current time is still within the opening treatment time, the processing shifts to step 103. In this step, as a result of control signals being sent to the respective valves, the bypass valve 24 is opened, the vent shut valve 26 is opened, and the purge control valve 30 is closed, so that the fuel discharge prevention system 31 is opened to the atmosphere.

Next, in step 104, a judgment is made as to whether or not the absolute value of the difference between the current output value (see FIG. 2A) of the internal pressure sensor and the initial value P1 of the tank pressure is equal to or greater than the first reference value, e.g., 4 mmHg, used to detect leakage caused by a hole with a diameter of 0.5 mm. Here, the initial value P1 of the tank pressure may be a positive pressure or a negative pressure depending on the conditions of use of the vehicle up to that point. Accordingly, the absolute value of P1−P2 is used for the judgment involved. If the absolute value of the pressure difference is equal to or greater than the first reference value, then a judgment is made that there is no leakage caused by a hole with a diameter of 0.5 mm or greater. In this case, the 0.5 mm OK flag is set at 1 (105), the 1 mm OK flag is set at 1, and the processing is ended.

In step 104, if the absolute value of P1−P2 is not equal to or greater than the first reference value, the processing shifts to step 107, and a judgment is made as to whether or not the absolute value of P1−P2 is equal to or greater than the reference value (e.g., 2 mmHg) used to detect leakage caused by a hole with a diameter of 1 mm or greater. If the judgment is "yes", the 1 mm OK flag is set at 1 (106), and the processing is ended. In this case, the 0.5 mm OK flag is zero, and the 1 mm OK flag is 1. Accordingly, in the subsequent internal pressure monitoring process, monitoring for the 0.5 mm diameter criteria is performed. The value P2 of the tank pressure during the opening treatment is stored in the RAM 93 for use in the internal pressure monitoring process.

Internal Pressure Monitoring

Next, the internal pressure monitoring process will be described with reference to FIG. 4. The object of internal pressure monitoring is to make a continuous check of the output level of the internal pressure sensor 11, and to judge that leakage is present in cases where this level is concentrated in the vicinity of atmospheric pressure, and that no leakage is present in cases where this level shifts greatly toward a positive pressure or negative pressure.

Figure 4:
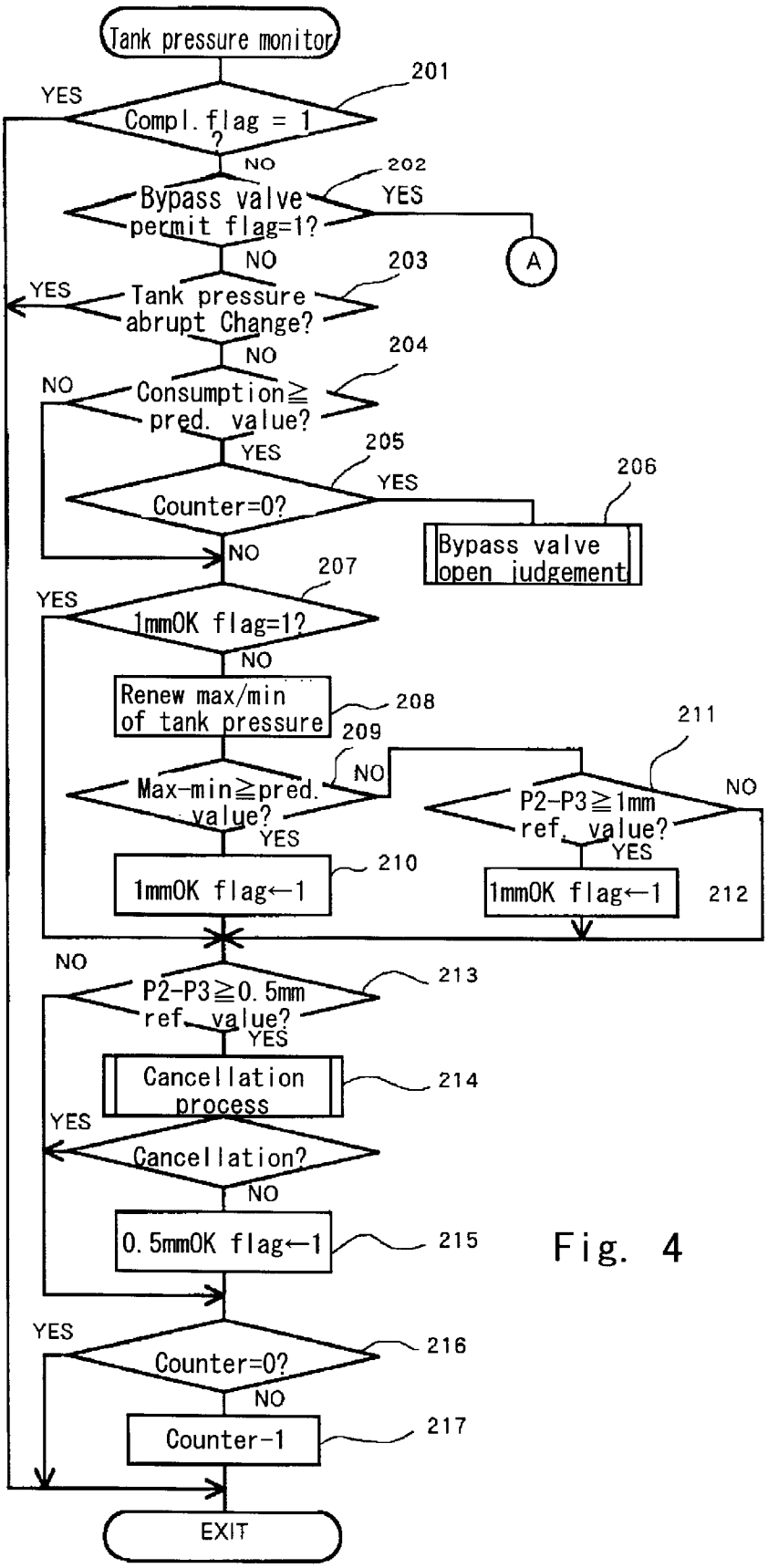
FIG. 4 is a flow chart illustrating the flow of internal pressure monitoring.
Figure 5:
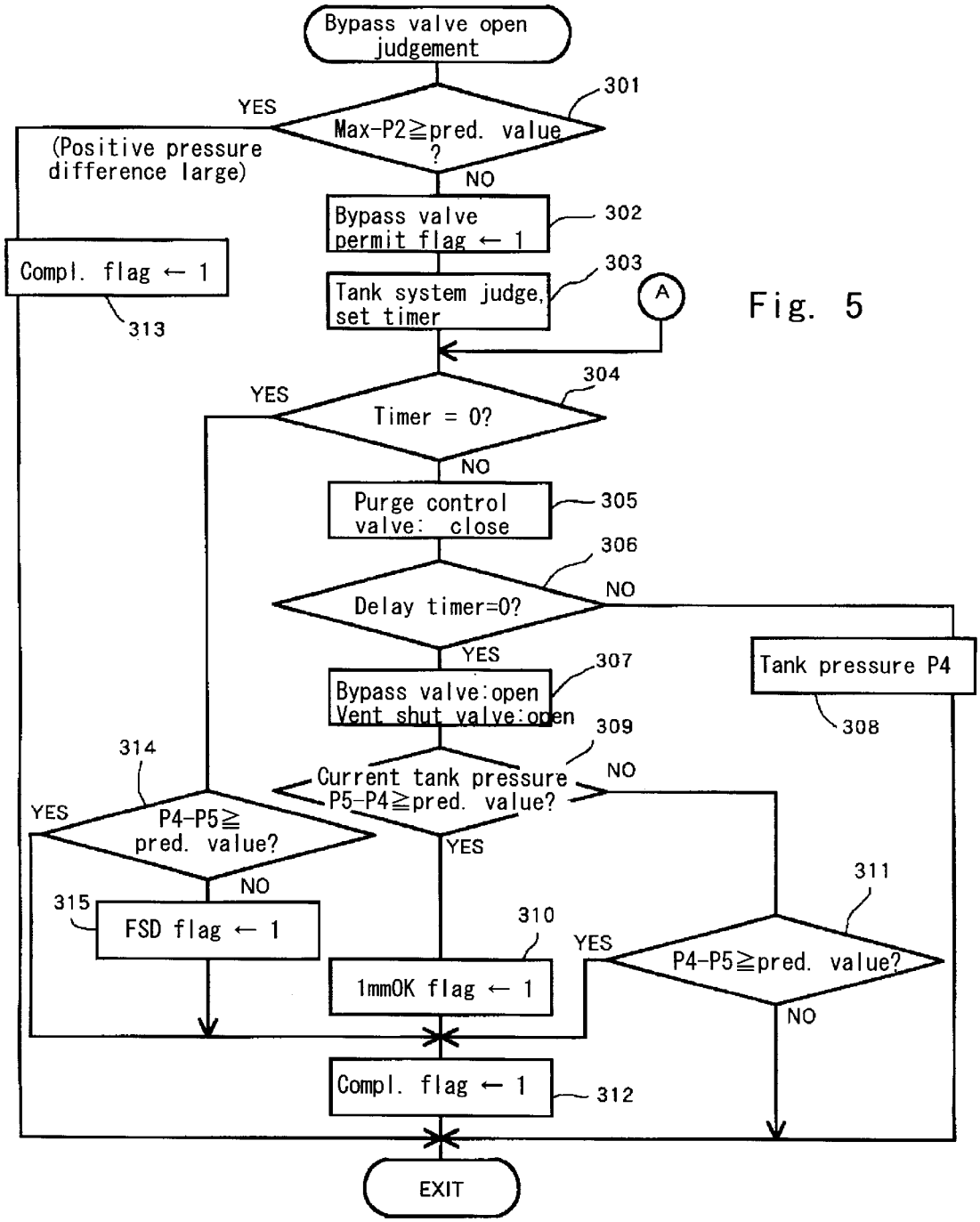
FIG. 5 is a flow chart illustrating the flow of bypass-valve-open judgment processing.

In cases where the completion flag, which is set at 1 when the series of internal pressure monitoring processes is completed, is not 1 (201), the process shown in FIG. 4 is initiated. In a state in which the bypass valve permission flag, which is set at 1 in processing that will be described later with reference to FIG. 5, is 1 (202), the processing proceeds to FIG. 5. In cases where this bypass valve permission flag is not 1, the processing proceeds to the process of step 203 and subsequent steps.

A judgment is made as to whether or not there has been an abrupt change in the tank pressure by making a comparison in order to ascertain whether or not the absolute value of the difference between the currently detected tank pressure and the tank pressure previously detected and stored in the RAM 93 is equal to or greater than a predetermined value (203). For example, an abrupt change in the tank pressure occurs when the fuel level oscillates as a result of abrupt starting of the vehicle into motion, etc., or when the fuel contacts the wall surfaces of the tank and is abruptly vaporized. Such conditions are not suitable for detecting vapor leakage. Accordingly, the processing is exited in such cases.

If it is judged that there has been no abrupt change in the tank pressure, the processing shifts to step 204, and a judgment is made as to whether or not the amount of fuel consumption is equal to or greater than a predetermined value. If the amount of fuel consumption is equal to or greater than this predetermined value, and the countdown timer is not at zero, then the processing proceeds to bypass-valve-open judgment processing that will be described later (206). This indicates a state in which the 1 mm OK flag is not set at 1, i.e., the 1 mm diameter criteria is not cleared, even though the processing from step 207 and on in FIG. 5 has been performed a predetermined number of times.

The calculation of the amount of fuel consumption in step 204 uses values calculated in the background of the process. Specifically, in the background, the CPU 91 multiplies the sum of the valve opening time of the fuel injection valve 6 in a predetermined period by a predetermined coefficient, and thus converts this value into the amount of fuel consumption during this predetermined period. This value is stored in the RAM 93, and is rewritten at predetermined intervals.

In cases where the amount of fuel consumption is smaller than a predetermined value in step 204, or in cases where the counter value is not zero in step 205, i.e., in cases where the predetermined number of repetitions of monitoring has not been reached, the processing shifts to step 207, and a check is made in order to ascertain whether or not the 1 mm OK flag is 1. This 1 mm OK flag is set in cases where the 1 mm diameter criteria is cleared in the tank pressure monitoring performed immediately after starting in FIG. 4.

If the 1 mm OK flag is not set at 1, the processing proceeds to step 208. Here, if the tank pressure currently indicated by the sensor 11 or the mean value obtained by sampling the output of the sensor 11 a predetermined number of times (in the present specification, the simple term "current tank pressure" may refer to a single measured value or the mean value of values sampled a plurality of times, depending on the nature of the processing) is greater than the maximum value of the tank pressure stored in the RAM 93 up to that time, the maximum value in the RAM 93 is rewritten as the current tank pressure: and if the current tank pressure is smaller than the minimum value of the tank pressure stored in the RAM 93 up to that time, the minimum value stored in the RAM 93 is rewritten as the current tank pressure.

If the difference between the maximum value and minimum value thus updated, i.e., the amplitude of the shift in the tank pressure, is equal to or greater than a predetermined value (209), it is judged that there is no leakage caused by a hole with a diameter of 1 mm or greater, and the 1 mm OK flag is set at 1 (210). Here, the predetermined value used in this judgment is a value read out from a map (using the engine water temperature (TW) at the time of starting as a parameter) stored in the ROM 92.

In cases where the amplitude of the shift in the tank pressure is smaller than the abovementioned predetermined value, the processing shifts to step 211. Here, if the difference between the tank pressure P2 measured with the system open to the atmosphere and stored in the RAM 93 in the tank pressure monitoring immediately following starting described with reference to FIG. 3 and the current tank pressure P3 (FIG. 2B) obtained from the internal pressure sensor II is equal to or greater than the reference value, e.g., 2 mmHg, used to detect leakage caused by a hole with a diameter of 1 mm or greater (211), it is judged that the tank system has the function of maintaining a negative pressure, and that there is no leakage according to the 1 mm diameter criteria. Accordingly, the 1 mm OK flag is set at 1 (212).

In cases where the 1 mm OK flag is set in step 207, cases where the 1 mm OK flag is set in step 210 or step 212, or cases where the value of P2−P3 is smaller than the 1 mm reference value in step 211, the processing shifts to step 213, and a judgment is made as to whether or not the value of P2−P3 is equal to or greater than the reference value for the 0.5 mm diameter criteria, e.g., 5 mmHg. If the value of P2−P3 is equal to or greater than this reference value, it is tentatively judged that the tank system has the function of maintaining a large negative pressure, and that there is no leakage according to the 0.5 mm criteria.

However, as will be described later in connection with the OK judgment cancellation processing, the tank pressure may assume a negative value as a result of special factors regardless of the presence or absence of leakage. Accordingly, the processing enters the cancellation processing subroutine of step 214, and a judgment is made as to whether or not such special factors are present. If it is judged in this subroutine that no special factors are present (that is, if it is decided not to cancel the judgment results of step 213), the 0.5 mm OK flag is set (215), and if the time counter has not reached zero (216), the process is exited after subtracting 1 from the time counter (217). If the time counter has reached zero, the process is exited "as is".

In the working example shown in FIG. 4, the program that executes the internal pressure monitoring process is invoked at predetermined time intervals, e.g., every 80 milliseconds, and this process is repeated until the time counter reaches zero (205). When the time counter reaches zero, the processing shifts to the bypass-valve-open judgment process (206) which is shown in detail in FIG. 5. In the bypass-valve-open process, the internal pressure monitoring completion flag is set in step 312 or 313. When this flag is set, the process in FIG. 4 detects this flag in step 201, and the processing is exited.

Accordingly, in one operating cycle (engine start to stop), after a series of internal pressure monitoring operations has been completed, the same internal pressure monitoring is not repeated. However, the frequency with which the operation is performed is a design matter, and it can be altered as necessary.

Bypass-Valve-Open Process

Next, the bypass-valve-open process will be described with reference to FIG. 5. This process is entered when the value of the time counter reaches zero in the process shown in FIG. 4 (205). Furthermore, this process is entered from step 304 in FIG. 6 in cases where it is detected that the bypass valve permission flag is set in the process shown in FIG. 5. A judgment is made as to whether or not the maximum value of the tank pressure updated in step 208 in FIG. 4 is greater (by a predetermined amount or more) than the tank pressure P2 measured with the system open to the atmosphere, which was detected in the post-starting tank pressure monitoring process shown in FIG. 3 and stored in the RAM 93 (301). If this maximum value of the tank pressure is greater than P2 by the abovementioned predetermined value or more, this means that the tank system had the function of maintaining a positive pressure from the time of starting onward. Accordingly, the internal pressure monitoring completion flag is set (313), and the processing is ended.

The predetermined value used in the judgment performed in step 301 is a value which uses the engine water temperature (TW) at the time of starting as a parameter, and it is stored in tabular form in the ROM of the ECU 5. In other words, in step 301, a predetermined value according to the engine water temperature is read out from the ROM, and a comparison is made in order to ascertain whether or not it (maximum value of tank pressure−P2) is equal to or greater than this predetermined value.

In cases where the result of the comparison made in step 301 is "no," the permission flag for opening the bypass valve is set (302), and the predetermined time that is to be spent on the processing shown in FIG. 5 is set in the tank system judgment timer (303). Since the timer value thus set is not initially zero, the processing proceeds to step 305 via step 304, and the purge control valve 30 is closed. Step 306 is a step that waits for the closing of the purge control valve to stabilize, since the delay timer has not reached zero at first, the processing proceeds to step 308, and the current mean value of the tank pressure, which is calculated in the background, is stored in the RAM 93.

Like the processing routine shown in FIG. 4, the processing routine shown in FIG. 5 is also invoked at predetermined time intervals, e.g., every 80 milliseconds. Accordingly, after the process is exited via step 308, the processing again enters this process, and if the delay time 306 [sic] is at zero, the ECU 5 sends control signals and opens the bypass valve and vent shut valve so that the tank system is opened to the atmosphere (307). In step 309, a judgment is made as to whether or not the current tank pressure P5 following the abovementioned opening to the atmosphere has increased by a predetermined value or greater from the tank pressure P4 measured prior to the abovementioned opening to the atmosphere. If the current tank pressure has increased by this predetermined value or greater, this indicates that the tank system had the function of maintaining a negative pressure. Accordingly, it is judged that there was no leakage caused by a hole with a diameter of 1 mm or greater. Consequently, the 1 mm OK flag is set (310), the internal pressure monitoring completion flag is set, and the process is exited (312).

In cases where the shift from negative pressure toward atmospheric pressure has not reached the abovementioned predetermined value in step 309, the processing shifts to step 311, and a judgment is made as to whether or not P4−P5 is equal to or greater than a predetermined value, i.e., as to whether or not the tank pressure P5 following the abovementioned opening to the atmosphere is smaller than the tank pressure P4 measured prior to the abovementioned opening to the atmosphere by a predetermined value or greater (that is , whether or not the tank pressure showed a large shift toward atmospheric pressure from a positive pressure). The predetermined value used here may be different from the predetermined value used in step 309. Typically, a value read out from a table (using the water temperature (TW) at the time of engine starting as a parameter) stored in the ROM of the ECU 5 is used.

If the pressure shift is large, this means that the tank system had the function of maintaining pressure; however, a shift from a positive pressure is not suitable for detecting the presence or absence of leakage caused by very small holes; accordingly, the completion flag is set (312) without setting the OK flag, and the process is exited. In cases where it is judged in step 311 that the shift in the pressure is not large, the judgment processing is repeated. Accordingly, the process is exited without setting the completion flag.

When the judgment process is repeated and the tank system judgment timer reaches zero (304), a judgment similar to that of step 311 is made in step 314. If the shift toward atmospheric pressure from a positive pressure is large, the completion flag is set and the processing is ended. If the shift is not large, the FSD flag is set (315), after which the completion flag is set and the processing is ended. The FSD flag is used along with numerous other flags in trouble diagnosis.

0.5 mm OK Judgment Cancellation Processing

Figure 6:
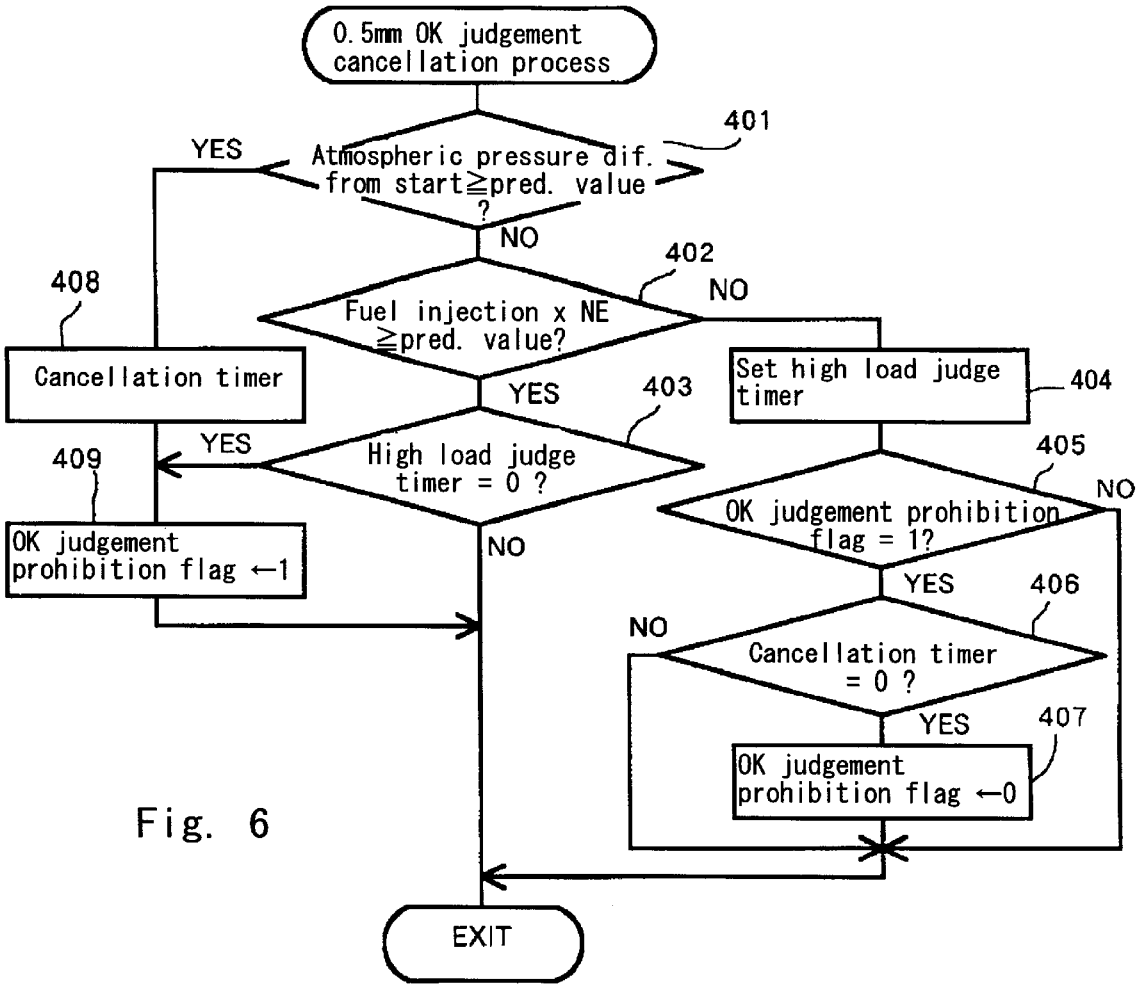
FIG. 6 is a flow chart illustrating the flow of the processing that cancels the judgment of the presence or absence of leakage.

FIG. 6 is a flow chart which shows the processing of the cancellation processing subroutine shown in FIG. 4. The object of this processing is as follows. In cases where a 0.5 mm OK judgment indicating that there is no leakage according to the 0.5 mm criteria has been made in the internal pressure monitoring process shown in FIG. 4 (213), this processing cancels this judgment and continues monitoring if there are special factors that might have an effect on this judgment.

Special factors that might have an effect on the 0.5 mm OK judgment include a state in which the vehicle is operating under a high load, and a state in which the vehicle is in the process of moving from a location at a high altitude to a location at a low altitude so that the atmospheric pressure varies greatly in the direction of increase.

In cases where the vehicle is operating under a high load, e.g., during rapid acceleration, etc., fuel is rapidly consumed so that the internal pressure sensor 11 temporarily senses a negative pressure. Accordingly, an OK judgment may be derived even if there is leakage caused by a very small hole with a diameter of 0.5 mm. Thus, such conditions are not suitable for making a judgment. Furthermore, when the atmospheric pressure increases as the vehicle runs from a location at a high altitude toward a location at a lower altitude, the internal pressure sensor 11, which senses the difference between atmospheric pressure and the pressure inside the tank, detects a pressure shift in the negative pressure direction. In this case, even if there is leakage caused by a very small hole with a diameter of approximately 0.5 mm, an OK judgment may be derived. Consequently, such conditions are not suitable for making a judgment. Accordingly, in such cases, the 0.5 mm OK judgment is cancelled.

In FIG. 6, a judgment is first made in step 401 as to whether or not the current atmospheric pressure exceeds the atmospheric pressure at the time that the engine was started (the value measured at the time that the engine was started is stored in the RAM 93) by a predetermined value, e.g., 5.5 mmHg, or greater. If it is judged that the current atmospheric pressure does exceed the initial atmospheric pressure by such a predetermined value or greater, the resulting conditions are not suitable for judging the presence or absence of leakage according to the 0.5 mm criteria (for the reasons described above). Accordingly, the cancellation timer is set at a predetermined time, e.g., 60 seconds (408), the OK judgment prohibition flag is set (409), and the 0.5 mm OK judgment in step 213 of FIG. 5 is cancelled. In the present working example, the magnitude of the shift in atmospheric pressure toward the high-pressure side used in the above-mentioned judgment, i.e., 5.5 mmHg, is a value that reduces the tank pressure by 3.3 mmHg.

In cases where the judgment in step 401 is "no", the processing proceeds to step 402, and a judgment is made as to whether or not a value (expressing the load on the engine) obtained by multiplying the engine rpm (NE) by the amount of fuel injection per unit time calculated by the ECU 5 in the background is equal to or greater than a predetermined value. If this value is equal to or greater than said predetermined value, the processing proceeds to step 403. In regard to the load value used in this judgment, a value that is close to the critical value affecting the judgment of the presence or absence of leakage according to the 0.5 mm criteria is selected on the basis of experimental data and simulated data.

In step 403, if a high-load operation judgment time which is set at a predetermined value, e.g., 4 seconds, in step 404 (described later) is at zero, i.e., if high-load operation has continued for 4 seconds, the OK judgment is cancelled (409), since such conditions (for the reasons described above) are not suitable for judging the presence or absence of leakage according to the 0.5 mm criteria. In cases where the timer is not at zero, this processing is passed over. However, since this cancellation processing subroutine is invoked every 80 milliseconds, a similar judgment is repeated.

If the load is greater than a predetermined value in step 402, the processing proceeds to step 404, and the high-load operation judgment timer is set at a predetermined time, e.g., 4 seconds. Then, if an OK judgment prohibition flag is set (405), the processing proceeds to step 406. If the cancellation timer (set in step 408) is at zero in step 406, the OK judgment prohibition flag is set at zero, and the judgment prohibition is cancelled. In other words, in the present working example, the prohibition of the OK judgment is cancelled in 60 seconds.

Thus, as a result of the completion of a series of internal pressure monitoring operations, the presence or absence of leakage according to the 1 mm criteria and 0.5 mm criteria is detected. In cases where the OK judgment flags for both the 1 mm criteria and the 0.5 mm criteria are set as a result of this internal pressure monitoring processing, it is judged that the tank system is normal, without any leakage, and the processing for the purpose of detecting the presence or absence of leakage is completed. In cases where neither of the OK judgment flags is set, or in cases where the OK judgment flag for the 1 mm criteria is set but the OK judgment flag for the 0.5 mm flag is not set, the presence or absence of leakage is detected by reduced-pressure monitoring in which the pressure in the tank system is sufficiently reduced and the negative pressure maintenance function is monitored.

Thus it has been shown that in accordance with one embodiment of the invention, a judgment that there is no leakage is made when the internal pressure sensor indicates a negative pressure and [the vehicle] is not in a high-load operating state. Accordingly, the erroneous interpretation of a negative pressure state in the tank system arising from a high-load operating state as a state in which there is no leakage in the tank system can be prevented. In accordance with another embodiment of the invention, a judgment that there is no leakage is made when the internal pressure sensor indicates a negative pressure and there is no change in atmospheric pressure that is equal to or greater than a predetermined value. Accordingly, the erroneous interpretation of a negative pressure state in the tank pressure arising from a change in atmospheric pressure as a state in which there is no leakage in the tank system can be prevented.

The present invention was described above with reference to predetermined embodiments. However, the present invention is not limited to the above embodiments, and any modifications and changes are possible, provided they do not depart from the scope of the attached claims and the equivalents thereof.

What is claimed is:

1. An evaporated fuel leak detection apparatus for an internal combustion engine having a fuel tank, a canister having an opening to the atmosphere, a charging passage allowing the fuel tank to communicate with the canister, and a pressure adjustment valve installed in the charging passage, the apparatus comprising an internal pressure sensor installed on the upstream side of the pressure adjustment valve for detecting the internal pressure of the fuel tank, and:

a controller for detecting leakage in the fuel tank system on the upstream side of the pressure adjustment valve based on the output of the sensor, said controller judging that there is no leakage when the internal pressure sensor indicates a negative pressure and the engine is not in a high-load driving condition.

2. An evaporated fuel leak detection apparatus for an internal combustion engine having a fuel tank, a canister having an opening to the atmosphere, a charging passage for allowing the fuel tank to communicate with the canister, and a pressure adjustment valve installed in the charging passage, the apparatus comprising an internal pressure sensor installed on the upstream side of the pressure adjustment valve for detecting the internal pressure of the fuel tank, and:

a controller that detects leakage in the fuel tank system on the upstream side of the pressure adjustment valve in accordance with the output of the sensor, said controller judging that there is no leakage when the internal pressure sensor indicates a negative pressure and variation of the atmospheric pressure is less than a predetermined value.

3. An evaporated fuel leak detection system for an automotive fuel tank system having a fuel tank associated with a fuel injection system of an automotive engine, the leak detection system comprising:

an engine load detection system configured to detect the load on the automotive engine and to generate an engine load signal;

a vapor pressure sensor configured to sense vapor pressure in the fuel tank and to generate a vapor pressure signal; and a processor configured to receive the engine load signal and the vapor pressure signal and to generate a no-leak signal when there is a negative vapor pressure in the fuel tank and the engine load is less than a predetermined value.

4. The system of claim 3 wherein the engine load detection system comprises an engine speed sensor configured to sense the engine speed and generate an engine speed signal, and a fuel consumption detection system configured to detect the amount of fuel consumed and to generate a fuel consumption signal, and further wherein the processor is configured to receive the engine speed signal and the fuel consumption signal and determine the engine load.

5. The system of claim 4 wherein the fuel consumption detection system comprises a fuel injection valve sensor configured to detect fuel injection valve opening time and to generate a valve opening time signal, and further wherein the processor is configured to receive the valve opening time signal and determine fuel consumption therefrom.

6. The system of claim 3 wherein the vapor pressure sensor is further configured to sense atmospheric pressure and to generate a corresponding atmospheric pressure signal, and wherein the processor is further configured to receive the atmospheric pressure signal and generate a no-leak signal when there is a negative vapor pressure in the fuel tank and the change in atmospheric pressure over a predetermined period of time is less than a predetermined value.

7. The system of claim 6, further comprising a valve for selectively exposing the vapor pressure sensor to atmospheric pressure and, alternatively, to vapor pressure in the fuel tank.

8. The system of claim 7, further comprising a controller configured to control operation of the valve.

9. The system of claim 7 wherein the processor is configured to store an initial vapor pressure signal corresponding to atmospheric pressure sensed at a first time and to compare a second vapor pressure signal corresponding to atmospheric pressure sensed at a second time to the initial vapor pressure signal and determine the change in atmospheric pressure.

10. An evaporated fuel leak detection method for an automotive fuel tank system having a fuel tank associated with an automotive engine having fuel injection valves, the method comprising:

monitoring vapor pressure in the fuel tank and monitoring atmospheric pressure and generating corresponding vapor pressure signals;

monitoring the load on the automotive engine and generating a corresponding engine load signal; and generating a no-leak signal when there is a negative vapor pressure in the fuel tank and the change in atmospheric pressure over a predetermined period of time is less than a predetermined value, and generating a no-leak signal when there is a negative vapor pressure in the fuel tank and the engine load is below a predetermined value.

11. The method of claim 10 wherein monitoring vapor pressure in the fuel tank and monitoring atmospheric pressure comprises alternately exposing a single vapor pressure sensor to vapor pressure in the fuel tank and to atmospheric pressure.

12. The method of claim 10 wherein determining the engine load comprises monitoring fuel injection valve opening time in the automotive engine and calculating fuel consumption therefrom, and monitoring the automotive engine speed and multiplying the automotive engine speed by the amount of fuel consumption.

13. The method of claim 10 wherein determining atmospheric pressure over a predetermined period of time comprises storing an initial vapor pressure signal corresponding to an atmospheric pressure at a first time and comparing a second vapor pressure signal corresponding to atmospheric pressure at a second time to the initial vapor pressure signal and determining the change in atmospheric pressure over the period of time between the first time and the second time.

14. The method of claim 13, further comprising comparing the change in atmospheric pressure over a predetermined period of time to a predetermined value.

* * * * *